United States Patent [19]

Hoffend et al.

[11] Patent Number: 4,560,635

[45] Date of Patent: Dec. 24, 1985

[54] TONER COMPOSITIONS WITH AMMONIUM SULFATE CHARGE ENHANCING ADDITIVES

[75] Inventors: Thomas R. Hoffend, Webster; Angelo J. Barbetta, Penfield, both of N.Y.

[73] Assignee: Xerox Corporation, Stamford, Conn.

[21] Appl. No.: 645,660

[22] Filed: Aug. 30, 1984

[51] Int. Cl.[4] ..... G03G 9/16

[52] U.S. Cl. ..... 430/106.6; 430/110; 430/59; 430/137

[58] Field of Search ..... 430/107, 110, 903, 59, 430/137, 106.6

[56] References Cited

U.S. PATENT DOCUMENTS

| | | | |
|---|---|---|---|
| 3,893,935 | 7/1975 | Jadwin et al. | 252/62.1 |
| 3,960,738 | 6/1976 | O'Brien et al. | 252/62.1 P |
| 3,977,983 | 8/1976 | Tsuneda | 252/62.1 L |
| 4,146,494 | 3/1979 | Hectors et al. | 252/62.1 P |
| 4,221,856 | 9/1980 | Lu | 430/110 |
| 4,264,698 | 4/1981 | Takayama et al. | 430/109 |
| 4,286,037 | 8/1981 | Hectors et al. | 430/107 |
| 4,291,111 | 9/1981 | Lu | 430/107 |
| 4,291,112 | 9/1981 | Lu | 430/110 |
| 4,299,898 | 11/1981 | Williams et al. | 430/106 |
| 4,312,933 | 1/1982 | Lu | 430/122 |
| 4,323,634 | 4/1982 | Jadwin | 430/110 |

OTHER PUBLICATIONS

Research Disclosure, #14017, Dec. 1975.

*Primary Examiner*—John L. Goodrow

*Attorney, Agent, or Firm*—E. O. Palazzo

[57] ABSTRACT

Disclosed in the present application are toner compositions comprised of resin particles, pigment particles, and a sulfate charge enhancing additive selected from the group consisting of distearyl dimethyl ammonium methyl sulfate, and behenyl trimethyl ammonium methyl sulfate.

30 Claims, No Drawings

TONER COMPOSITIONS WITH AMMONIUM SULFATE CHARGE ENHANCING ADDITIVES

BACKGROUND OF THE INVENTION

This invention is generally directed to developer compositions, and more specifically, the present invention is directed to toner compositions, including magnetic toner compositions, containing therein certain charge enhancing additives, which impart a positive charge to the toner resin particles. Compositions with the specific quaternary ammonium sulfate charge enhancing additives of the present invention are useful for causing the development of electrostatic latent images, including color images. More specifically, positively charged toner compositions having incorporated therein these charge enhancing additives are particularly useful in electrostatographic imaging systems with a Viton coated fuser roll, since the sulfate additives involved do not react substantially with Viton, causing undesirable decomposition thereof, thereby adversely affecting image quality. Moreover, the toner compositions of the present invention with the charge enhancing additives therein, particularly distearyl dimethyl ammonium methyl sulfate, (DDAMS), can be desirably prepared by extrusion toner processing.

Developer compositions containing charge enhancing additives, including those which impart a positive charge to the toner resin, are well known. Thus, for example, there is described in U.S. Pat. No. 3,893,935, the use of certain quaternary ammonium salts as charge control agents for electrostatic toner compositions. In accordance with the disclosure of this patent, specific quaternary ammonium salts when incorporated into a toner material provided a composition which exhibited relatively high uniform stable net toner charge when mixed with a suitable carrier vehicle, and this material also exhibited a minimum amount of toner throw off. Also, there is disclosed in U.S. Pat. No. 4,338,390 developer and toner compositions having incorporated therein as charge enhancing additives organic sulfate and sulfonate compositions. Other patents disclosing toner compositions with charge control additives include U.S. Pat. Nos. 3,944,493; 4,007,293; 4,079,014 and 4,394,430.

Further, there is disclosed in U.S. Pat. No. 2,986,521 reversal developer compositions comprised of toner resin particles coated with finely divided colloidal silica. According to the disclosure of this patent, the development of electrostatic latent images on negatively charged surfaces is accomplished by applying a developer composition having a positively charged triboelectric relationship with respect to the colloidal silica.

Moreover, there is disclosed in U.S. Pat. No. 4,298,672 positively charged toner compositions containing resin particles, and pigment particles, and as a charge enhancing additive alkyl pyridinium compounds and their hydrates of the formula as detailed in column 3, beginning at line 14. Examples of alkyl pyridinium compounds disclosed include cetyl pyridinium chloride. While the developer compositions disclosed in the U.S. Pat. No. 4,298,672 are sufficient for their intended purposes, it appears that the alkyl pyridinium compounds involved react with the polymer contained on Viton fuser rolls causing decomposition thereof. Also, several of the other charge control agents disclosed in the prior art interact with certain fuser rolls, such as Viton fuser rolls, used in electrostatographic systems. This interaction causes the fuser to be adversely affected resulting in the deterioration of image quality. For example, Viton fuser rolls discolor and turn black, develop multiple surface cracks and harden when certain charge control additive compounds are contained in the toner mixture.

One Viton fuser roll selected for use in electrostatographic copying machines is comprised of a soft roll fabricated from lead oxide, and duPont Viton E-430 resin, vinylidene fluoride hexafluoropropylene copolymer. This roll contains approximately 15 parts of lead oxide, and 100 parts of Viton E-430, which mixture is blended and cured on the roll substrate at elevated temperatures. Apparently the function of the lead oxide is to retain the liberated hydrogen fluoride gas, assist in the crosslinking reaction, contribute to degradative stability, generate unsaturation by dehydrofluorination for crosslinking, and to provide release mechanisms for the toner composition. Excellent image quality has been obtained with Viton fuser rolls, however, in some instances there results a toner fuser compatibility problem when charge control agents are part of the toner mixture. For example, it appears that certain specific charge control additives, such as quaternary ammonium compounds, and alkyl pyridinium compounds, including cetyl pyridinium chloride, react with the Viton of the Viton fuser roll. For example, cetyl pyridinium chloride when part of the toner mixture appears to be catalytically decomposed by the lead oxide contained in the fuser roll resulting in a highly unsaturated compound, which polymerizes and condenses with the unsaturated Viton E-430 material. In view of this, the Viton fuser roll turns black, develops multiple surface cracks, and the surface thereof hardens thereby resulting in image quality deterioration.

Toner compositions with many of the above described charge enhancing additives are useful for causing the development of images formed on layered photoresponsive imaging devices comprised of generating layers and transport layers. These devices are charged negatively, rather than positively as is usually the situation with selenium photoreceptors, thus a toner composition which is positively charged is required in order that the toner particles may be suitably attracted to the electronstatic latent image contained on the photoreceptor surface. In view of this, efforts have been devoted to obtaining developer compositions containing toner resins which are positively charged. Thus, while many charge control additives are known, for this purpose there continues to be a need for new additives. Specifically, there continues to be a need for additives which will not interact with Viton type fuser rolls. Moreover, there continues to be a need for positively charged toner and developer compositions possessing rapid admix charging characteristics. Further, there continues to be a need for new charge enhancing additives which can be economically prepared. Additionally, there is a need for substantially nontoxic charge enhancing additives, and a need for charge enhancing additives which can be easily and permanently dispersed in toner resin particles. Also, there is a need for toner compositions with charge stability which can be desirably obtained by extrusion toner processing.

SUMMARY OF THE INVENTION

It is an object of the present invention to provide toner and developer compositions containing certain quaternary ammonium sulfate charge enhancing additives, which overcome some of the above-noted disadvantages.

In another object of the present invention there is provided positively charged toner compositions which are useful for causing the development of electrostatic latent images including color images.

In yet another object of the present invention there is provided positively charged toner compositions containing as charge enhancing additives specific quaternary ammonium sulfate compositions.

Another object of the present invention resides in the provision of charge enhancing additives which do not cause significant degradation of Viton rubber selected for use in imaging systems with certain fusing roll devices.

In another object of the present invention there is provided a developer composition comprised of positively charged toner particles, carrier particles and quaternary ammonium sulfate charge enhancing additives.

In yet a further object of the present invention there are provided positively charged toner compositions with desirable admix properties.

In a further object of the present invention there are provided magnetic toner compositions, and colored toner compositions comprised of positively charged toner particles, carrier particles, and specific quaternary ammonium sulfate charge enhancing additives.

In yet a further object of the present invention there are provided positively charged toner compositions containing certain quaternary ammonium sulfate charge enhancing additives, with stable charging characteristics, and wherein these compositions are preferably obtained by toner extrusion processing.

These and other objects of the present invention are accomplished by providing developer compositions, and toner compositions wherein the dry electrostatic toner compositions are comprised of resin particles, pigment particles, and quaternary ammonium sulfate charge enhancing additives selected from the group consisting of distearyl dimethyl ammonium methyl sulfate, and behenyl trimethyl ammonium methyl sulfate.

The specific quaternary ammonium sulfate charge enhancing additives disclosed herein, which are known compositions of matter, can be prepared by the reaction of an appropriate amine with a dialkylsulfate. More specifically, thus dimethylsulfate, can be added dropwise to a solution of the amine reactant, followed by heating. Thereafter, and subsequent to cooling the desired product is separated from the reaction mixture, and identified by analytical tools, including infrared spectroscopy and elemental analysis. Usually the reactants are present in equal molar quantities, and heating is effected at a temperature of from about 40 to about 60 degrees Centigrade, however, other temperatures can be selected provided the objectives of the present invention are achieved.

Illustrative examples of amine reactants include distearyl methylamine, behenyl dimethylamine, and the like, while examples of suitable solvents that can be used are acetone, and methyl ethyl ketone.

Illustrative examples of suitable toner resins selected for the toner and developer compositions of the present invention include polyamides, polycarbonates, epoxies, polyurethanes, vinyl resins and polymeric esterification products of a dicarboxylic acid and a diol comprising a diphenol. Any suitable vinyl resin may be selected for the toner resins of the present application including homopolymers or copolymers of two or more vinyl monomers. Typical of such vinyl monomeric units include: styrene, p-chlorostyrene, vinyl naphthalene, unsaturated mono-olefins such as ethylene, propylene, butylene, isobutylene and the like; diolefins, such as butadiene and the like; vinyl halides such as vinyl chloride, vinyl bromide, vinyl fluoride, vinyl acetate, vinyl propionate, vinyl benzoate, vinyl butyrate and other similar vinyl substances; vinyl esters such as esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, butyl methacrylate, and the like; acrylonitrile, methacrylonitrile, acrylaminde, vinyl ethers, such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl indole, N-vinyl pyrrolidene and the like; styene butadiene copolymers, and mixtures thereof.

As one preferred toner resin there can be selected the esterification products of a dicarboxylic acid and a diol comprising a diphenol. These materials are illustrated in U.S. Pat. No. 3,590,000, the disclosure of which is totally incorporated herein by reference. Other preferred toner resins include styrene/methacrylate copolymers, and styrene/butadiene copolymers, polyester resins obtained from the reaction of bis-phenol A and propylene oxide, followed by the reaction of the resulting product with fumaric acid, and branched polyester resins resulting from the reaction of dimethylterephthalate, 1,3-butanediol, 1,2-propanediol, and pentaerythritol.

The resin particles are present in a sufficient, but effective amount, thus when 5 percent by weight of the charge enhancing additive of the present invention is present, and 10 percent by weight of pigment, or colorant such as carbon black is contained therein, about 85 percent by weight of resin material is selected. Generally, from about 0.1 weight percent to about 10 weight percent and preferably from about 0.25 weight percent to about 5 weight percent, and more preferably from about 1 percent by weight to about 3 percent by weight, of the specific sulfate charge enhancing additive is selected from mixing with the toner particles, however, the charge enhancing additive can be present in other amounts providing the objectives of the present invention are accomplished. The charge enhancing additive of the present invention can be blended into the toner composition, or coated on the pigment particles, such as carbon black, which are used as the colorants in the developer composition. When used as a coating, the charge enhancing additive of the present invention is present in an amount of from about 0.1 weight percent to about 5 weight percent and preferably in an amount of from about 0.3 weight percent to about 2 weight percent.

Numerous well known suitable pigments or dyes can be selected as the colorant for the toner particles including, for example, carbon black, nigrosine dye, analine blue, magnetites and mixtures thereof. The pigment, which is preferably carbon black, is usually present in a sufficient amount to render the toner composition highly colored. Generally, the pigment particles are present in amounts of from about 2 percent by weight to about 20 percent by weight, and preferably in an amount of from about 4 percent by weight to about 12 percent by weight, based on the total weight of the toner composition, however, lesser or greater amounts of pigment particles can be selected providing the objectives of the present invention are achieved.

When the pigment particles are comprised of magnetites, that is a mixture of iron oxides ($FeO.Fe_2O_3$), they are present in the toner composition in an amount of from about 10 percent by weight to about 60 percent by weight, and preferably in an amount of from about 15 percent by weight to about 50 percent by weight.

Also embraced within the scope of the present invention are colored toner compositions comprised of toner resin particles, the sulfate charge enhancing additives illustrated herein, and as pigments or colorants, magenta, cyan, and/or yellow particles, as well as mixtures thereof. More specifically, with regard to the production of color images utilizing a developer composition containing the charge enhancing additives of the present invention, illustrative examples of magenta materials that may be selected as pigments, include for example, 2, 9-dimethyl-substituted quinacridone and anthraquinone dye identified in the color index as Cl 60710, Cl Dispersed Red 15, a diazo dye identified in the color index as Cl 16050, Cl Solvent Red 19, and the like. Illustrative examples of cyan materials that may be used as pigments include copper tetra-4(octadecyl sulfonamido) phthalocyanine, X-copper phthalocyanine pigment listed in the color index as Cl 74160, Cl Pigment Blue, and Anthrathrene Blue, identified in the color index as Cl 69810, Special Blue X-2137, and other similar compositions; while illustrative examples of yellow pigments that may be selected include diarylide yellow 3,3-dichlorobenzidene acetoacetanilides, a monoazo pigment identified in the color index as Cl 12700, Cl Solvent Yellow 16, a nitrophenyl amine sulfonamide identified in the color index as Foron yellow SE/GLN, Cl dispersed yellow 33, 2,5-dimethoxy-4-sulfonanilide phenylazo-4'-chloro-2,5-dimethoxy aceto-acetanilide, permanent yellow FGL, Lithol Scarlet Red, and the like.

The cyan, magenta, and yellow pigments when used with the charge enhancing additives of the present invention are generally present in the toner composition in an amount of from about 2 weight percent to about 15 percent based on the weight of the toner resin particles.

Illustrative examples of carrier particles that can be selected for mixing with the toner components of the present invention include those particles that are capable of triboelectrically obtaining a charge of opposite polarity to that of the toner particles. Accordingly, the carrier particles of the present invention are selected so as to be of a negative polarity enabling the toner particles which are positively charged to adhere to and surround the carrier particles. Illustrative examples of carrier particles include granular zircon, granular silicon, glass, steel, nickel, iron ferrites, silicon dioxide, and the like. Additionally, there can be selected as carrier particles nickel berry as disclosed in U.S. Pat. No. 3,847,604, the disclosure of which is totally incorporated herein by reference, and comprised of nodular carrier beads of nickel, characterized by surfaces of reoccuring recesses and protrusions thereby providing particles with a relatively large external area.

The selected carrier particles can be used with or without a coating, the coating generally comprising fluoropolymers, such as polyvinylidenefluoride resins, tetrafluoroethylenes, terpolymers of styrene, methylmethacrylate, and a silane, such as triethoxy silane, chloropolymers including vinylchloride/vinylacetate copolymers, vinylidenefluoride/chlorotrifluoroethylene copolymers, vinylchloride/chlorotrifluoroethylene copolymers, and the like.

The diameter of the carrier particles can vary, generally however it is from about 50 microns to about 1,000 microns, thus allowing these particles to possess sufficient density and inertia to avoid adherence to the electrostatic images during the development process. The carrier particles can be mixed with the toner particles in various suitable combinations, however, best results are obtained when about 1 part of toner to about 10 parts to about 200 parts by weight of carrier are mixed.

The toner composition of the present invention can be prepared by a number of known methods, including melt blending the toner resin particles, preferably by extrusion, pigment particles or colorants, and the charge enhancing additive of the present invention, followed by mechanical attrition. Other methods include those well known in the art such as spray drying, dispersion polymerization, and suspension polymerization. In one dispersion method, a liquid dispersion of the resin particles, the pigment particles, and the charge enhancing additive are spray dried under controlled conditions to result in the desired product. There results from these processes a positively charged toner composition in relation to the carrier materials selected, and these materials exhibit the improved properties as mentioned hereinbefore.

The toner and developer compositions of the present invention may be selected for use in developing images in electrostatographic imaging systems, having incorporated therein conventional photoreceptors providing they are capable of being charged negatively. This usually occurs with organic photoreceptors illustrative examples of which include layered photoresponsive devices comprised of transport layers and photogenerating layers, reference U.S. Pat. No. 4,265,990, the disclosure of which is totally incorporated herein by reference, and other similar layered photoresponsive devices. Examples of generating layers include trigonal selenium, metal phthalocyanines, metal free phthalocyanines and vanadyl phthalocyanines, while examples of charge transport layers include the diamines as disclosed in U.S. Pat. No. 4,265,990. Other useful photoresponsive imaging members may include 2-benzylideneaminocarbazone, 4-dimethylamino-benzylidene, (2-nitro-benzylidene)-p-bromoaniline; 2,4-diphenyl-quinazoline; 1,2,4-triazine; 1,5-dipheny-3-methyl pyrazoline 2-(4'-dimethyl-amino phenyl)-benzoaxzole; 3-amino-carbazole, polyvinyl carbazole-trinitrofluorenone charge transfer complex; and mixtures thereof.

The toner and developer compositions of the present invention are particularly useful in development systems wherein there is provided a development apparatus comprised of a moving deflected tensioned flexible imaging member, and a moving transporting member, wherein toner particles are triboelectrically charged in a charging zone situated therebetween, reference U.S. Pat. Nos. 4,394,429 and 4,368,970, the disclosure of which are totally incorporated herein by reference. Other development systems within which the toner compositions of the present invention are useful include those as described in copending application U.S. Ser. No. 286,784 entitled Apparatus, Process for Charging Toner Particles, the disclosure of which is totally incorporated herein by reference.

The following examples are being supplied to further define various species of the present invention, it being noted that these examples are intended to illustrate and not limit the scope of the present invention. Parts and percentages are by weight unless otherwise indicated.

EXAMPLE I

There was prepared by extrusion processing a toner composition containing 1 percent by weight of the charge enhancing additive distearyl dimethyl ammonium methyl sulfate, 6 percent by weight of carbon black, 93 percent by weight of a styrene butadiene resin, 10 parts of styrene, and 1 part butadiene prepared by an emulsion polymerization method, reference U.S. Ser. No. 453,253, titled Styrene Butadiene Plasticizer Toner Composition Blends, the disclosure of which is totally incorporated herein by reference. The extrusion process which is well known involves melt mixing the above components on an extruder.

A developer composition was then prepared by mixing 200 grams of carrier particles, and 5.50 grams of the above prepared toner composition. The carrier particles consisted of a steel core containing as a coating thereon, 1.25 percent of a copolymer of vinylchloride/chlorotrifluoroethylene, with the coating having dispersed therein 15 percent by weight of carbon black. Mixing was accomplished by placing the toner particles and carrier particles in an 8 ounce glass jar, followed by locating the jar with a tightened screw cap thereon, on a paint shaker for 10 minutes. Subsequent to removal of a sample of developer composition, a standard blow off tribo measurement was affected. The resulting positive triboelectric charge for the toner was 37 microcoulombs per gram.

EXAMPLE II

A developer composition was prepared by repeating the procedure of Example I with the exception that no charge enhancing additive was included therein, and 94 percent by weight of the resin was selected. The toner subsequent to the tribo blow off measurement possessed a positive triboelectric charge thereon of only 15 microcoulombs per gram.

EXAMPLE III

A magnetic toner composition was prepared by repeating the procedure of Example I with the exception that there was selected 80.5 percent by weight of the resin, 4 percent by weight of carbon black particles, 15 percent by weight of black magnetite particles, and 0.5 percent by weight of the charge enhancing additive distearyl dimethyl ammonium methyl sulfate.

Subsequent to the tribo blow off measurement test, reference Example I, it was determined that the toner composition possessed a positive triboelectric charge of 39 microcoulombs per gram.

EXAMPLE IV

A magnetic toner composition was prepared by repeating the procedure of Example III, with the exception that there was selected 79.5 percent by weight of the resin, and 1.5 percent by weight of the charge enhancing additive. There resulted a positive triboelectric charge on the toner of 38 microcoulombs per gram.

EXAMPLE V

There was prepared a magnetic toner composition by repeating the procedure of Example III, with the exception that there was selected 80.0 percent by weight of the resin, and 1.0 percent by weight of the charge enhancing additive. Also, the carrier coating had dispersed therein 7.5 percent by weight of carbon black. There resulted a positive triboelectric charge on the toner particles of 41 microcoulombs per gram.

This toner composition was then incorporated into a xerographic imaging test fixture wherein the development apparatus contained a moving deflected flexible imaging member, and a moving toner transporting member, and wherein the toner particles are charged in a charging zone situated between these members, reference U.S. Pat. Nos. 4,394,429 and 4,368,970, the disclosures of which are totally incorporated herein by reference, and there resulted for more than 100,000 imaging cycles, developed images of high resolution, excellent solids, superior halftones, and low background.

The imaging member selected comprised a supporting substrate of Mylar, overcoated with a photogenerating layer of trigonal selenium dispersed in a polycarbazole resinous binder, and as a top layer in contact with the photogenerating layer N,N'-diphenyl N,N'-bis(3-methylphenyl) 1,1'-biphenyl-4,4'-diamine transport molecules dispersed in a polycarbonate resinous binder commercially available as Makrolon, reference U.S. Pat. No. 4,265,990, the disclosure of which is totally incorporated herein by reference.

The imaging test fixture also contained a Viton fuser roll, and visual observation after 50,000 imaging cycles indicated that no damage occured to the Viton fuser roll, that is the Viton did not crack, and the surface did not harden, but rather remained smooth and soft. This test was performed under stress imaging conditions which approximate 500,000 typical fusing cycles.

EXAMPLE VI

A developer composition was prepared by repeating the procedure of Example I with the exception that the carrier selected consisted of an oxidized Hoeganes core with an 0.2 percent coating of Kynar.

Also the developer mixture was prepared by placing 200 grams of the above carrier composition, and 5.50 grams of the toner composition of Example I in an 8 ounce glass jar placed on a roll mill for 5 hours. A sample of this developer was then extracted from the glass jar, and the standard tribo blow off measurement process indicated a positive triboelectric charge on the toner of 50 microcoulombs per gram.

EXAMPLE VII

A developer composition was prepared by repeating the procedure of Example VI with the exception that no charge enhancing additive was used, and 94 percent by weight of the resin was selected. The toner composition had a triboelectric charge thereon of −11 microcoulombs per gram.

EXAMPLE VIII

A developer composition was prepared by repeating the procedure of Example VI with the exception that there was selected as the charge enhancing additive 1 percent by weight of behenyl trimethylammonium methylsulfate (BTAMS). The toner possessed a positive triboelectric charge thereon of 27.5 microcoulombs per gram, and further had an admix charging time of less than 15 seconds, as determined by a charge spectrograph.

EXAMPLE IX

A developer composition was prepared by repeating the procedure of Example I with the exception that there was selected 80 percent by weight of a styrene butadiene resin prepared by suspension polymerization, reference U.S. Ser. No. 453,252, filed Dec. 27, 1982, the disclosure of which is totally incorporated herein by reference, and there was also present 15 percent by weight of the magnetite particles, 4 percent by weight of carbon black, and 1 percent by weight of the charge enhancing additive. Moreover, the carrier selected was identical to that used in Example V. The toner possessed a triboelectric charge thereon of +41 microcoulombs per gram.

EXAMPLE X

A magnetic developer composition was prepared by repeating the procedure of Example IX, with the exception that there was selected a styrene/n-butylmethacrylate resin, (58/42), as a replacement for the styrene butadiene resin, and the carrier coating had dispersed therein 6 percent by weight of carbon black. The toner possessed a triboelectric charge thereon of 32 microcoulombs per gram.

EXAMPLE XI

A developer composition was prepared by repeating the procedure of Example IX wherein the carrier selected consisted of steel core coated with 1.25 percent of a vinylchloride/chlorotrifluoroethylene, which coating had dispersed therein 6 percent by weight of carbon black particles. The toner possessed a triboelectric charge thereon a positive 47 microcoulombs per gram, and the toner admixed in a period of less than 15 seconds as determined by the charge spectrograph.

Images were then developed in an imaging test fixture with the imaging member of Example V and there resulted for 50,000 cycles, images of excellent resolution, superior halftones, and reduced background. The imaging test fixture also contained a Viton fuser roll, and visual observation after 50,000 cycles indicated that no damage occured to the Viton fuser roll, that is the Viton did not crack, and the surface did not harden, but rather remained smooth and soft.

EXAMPLE XII

There were prepared the following toner compositions by the extrusion process of Example I, and subsequently developer compositions were prepared by mixing carrier particles with the toner composition in accordance with the procedure of Example I. The roll mill triboelectric charge of each toner composition, at a 0.0275 grams toner/grams carrier ratio, was then determined. The carrier in each instance consisted of an oxidized Hoeganese core with an 0.15 percent by weight of a polyvinylidene fluoride coating thereon. With regard to the triboelectric charging values reported, it is well known that numbers of about 5 microcoulombs or less per gram are usually not suitable for magnetic brush development.

1. Toner composition with styrene butadiene resin, 93 percent by weight, 6 percent by weight of carbon black, and 1 percent by weight of (3-laurylamidopropyl) trimethyl ammonium methyl sulfate (Cyastat LS). This toner had positive triboelectric charge of 1.0 microcoulombs per gram.

2. Toner composition with styrene/butadiene resin, 92 percent by weight, 6 percent by weight of carbon black, and 2 percent by weight of Cyastat LS. This toner had a negative triboelectric charge.

3. Toner composition with styrene/n-butylmethacrylate, 58/42, 93 percent by weight, 6 percent by weight of carbon black, and 1 percent by weight of Cyastat LS. This toner had positive triboelectric charge of 4.9 microcoulombs per gram.

4. Toner composition with a styrene butadiene resin, 93 percent by weight, 6 percent by weight of carbon black, and 1 percent by weight of DDAMS. This toner had a positive triboelectric charge of 27.3 microcoulombs per gram.

5. Toner composition with styrene butadiene resin, 93 percent by weight, 6 percent by weight of carbon black, and 1 percent by weight of behenyl trimethyl ammonium methyl sulfate (BTAMS). This toner had a positive triboelectric charge of 27.5 microcoulombs per gram.

6. Toner composition with styrene butadiene resin, suspension polymerized, 93 percent by weight, 6 percent by weight of carbon black, and 1 percent by weight of Cyastat LS. This toner had a triboelectric charge of 0.4 microcoulombs per gram.

7. Toner composition with styrene butadiene resin, suspension polymerized, 93 percent by weight, 6 percent by weight of carbon black, and 1 percent by weight of DDAMS. This toner had a positive triboelectric charge of 18.6 microcoulombs per gram.

The Cyastat LS is very sensitive to relative humidity, while in contrast the DDAMS charge enhancing additive of the present invention is substantially insensitive to moisture. Thus, it was determined that at relative humidities of 20, 50 and 80 percent, that the Cyastat absorbed 0.79 percent, 1.1 percent, and 19.3 percent by weight of water, while the DDAMS absorbed 0.01 percent, 0.22 percent, and 0.66 percent by weight of water.

The evaluation of the interaction of certain charge enhancing additives with the Viton fuser elastomer was also accomplished by inserting a strip of Viton approximately $\frac{1}{8}''$ thick, a length of $\frac{3}{4}''$ and a width of $\frac{1}{2}''$, in separate charge enhancing additives contained in test tubes with about 50 percent of the Viton strip submerged in the charge enhancing additive to be tested. The test tube was then heated to 200° C. for a period of 24 hours and the Viton fuser strip was removed. After removal of the charge control agent residue using isopropanol and drying, the Viton fuser strip was examined visually for discoloration, surface cracks and a determination was made as to whether the surface thereof hardened by, for example using a durometer, which measures indentation hardness. With the charge enhancing additive DDAMS of the present invention, minimal interaction resulted with the Viton elastomer, whereas with cetylpyridinium chloride and distearyldimethyl ammonium chloride the Viton elastomer was significantly adversely effected in that it contained cracks thereon. Also, with the charge enhancing additive stearyltrimethyl ammonium methyl sulfate, the Viton elastomer was adversely effected in that it hardened.

Other modifications of the present invention may occur to those skilled in the art based upon a reading of the present disclosure and these modifications are intended to be included within the scope of the present invention.

We claim:

1. An improved positively charged toner composition comprised of resin particles, pigment particles, and a sulfate charge enhancing additive selected from the group consisting of distearyl dimethyl ammonium methyl sulfate, and behenyl trimethyl ammonium methyl sulfate.

2. A composition in accordance with claim 1 wherein the charge enhancing additive is present in an amount of from about 0.1 percent by weight to about 10 percent by weight.

3. A composition in accordance with claim 1 wherein the resin particles are selected from the group consisting of polyesters, styrene based polymers, and polycarbonates.

4. A composition in accordance with claim 3 wherein the styrene based polymers are styrene/n-butylmethacrylates, styrene/n-butylacrylates, or styrene butadiene.

5. A composition in accordance with claim 1 wherein the pigment particles are present in an amount of from about 2 percent by weight to about 20 percent by weight.

6. A composition in accordance with claim 1 wherein the pigment particles are comprised of magnetites present in an amount of from about 10 percent by weight to about 60 percent by weight.

7. An improved developer composition comprised of the positively charged toner composition of claim 1, and carrier particles.

8. A developer composition in accordance with claim 7 wherein the carrier particles are comprised of steel coated with a polymeric resin.

9. A developer composition in accordance with claim 7 wherein the charge enhancing additive is distearyl dimethyl ammonium methyl sulfate.

10. A developer composition in accordance with claim 7 wherein the charge enhancing additive is behenyl trimethyl ammonium methyl sulfate.

11. A developer composition in accordance with claim 7 wherein the charge enhancing additive is distearyl methyl ethyl ammonium ethyl sulfate.

12. A developer composition in accordance with claim 7 wherein the resin particles are selected from the group consisting of polyesters, styrene/n-butylmethacrylate copolymers, styrene/n-butylacrylate copolymers, and styrene butadiene copolymers.

13. A method of imaging which comprises forming a negative electrostatic latent image on a photoresponsive imaging member, contacting the resulting image with the toner composition of claim 1, followed by subsequently transferring the developed image to a suitable substrate, and permanently affixing the image thereto.

14. A method of imaging in accordance with claim 13 wherein fixing is accomplished with a fuser roll containing lead oxide and a vinylidene fluoride hexafluoropropylene copolymer.

15. A method of imaging in accordance with claim 13 wherein the photoresponsive member is comprised of a substrate, a photogenerating layer, and a charge transport layer.

16. A method of imaging in accordance with claim 15 wherein the photogenerating layer is trigonal selenium or vanadyl phthalocyanine, optionally dispersed in a resin binder, and the charge transport layer is comprised of N,N'-diphenyl-N,N'-bis(3-methylphenyl) 1,1'-biphenyl-4,4'-diamine dispersed in a polycarbonate resin.

17. A method of imaging in accordance with claim 16 wherein the charge enhancing additive is distearyl dimethyl ammonium methylsulfate, or behenyl trimethyl ammonium methyl sulfate.

18. A method of imaging in accordance with claim 17 the charge enhancing additive is stearyl dimethyl ammonium methylsulfate, behenyl trimethyl ammonium methyl sulfate, or distearyl methyl ethyl ammonium ethyl sulfate.

19. A composition in accordance with claim 1 wherein the pigment particles are selected from magenta, cyan, and yellow pigments.

20. A toner composition in accordance with claim 1 generated by extrusion processing.

21. A toner composition in accordance with claim 1 wherein the pigment particles are carbon black present in an amount of from about 2 percent by weight to about 20 percent by weight.

22. A toner composition in accordance with claim 1 wherein the pigment particles are comprised of a mixture of carbon black particles and magnetites.

23. A toner composition in accordance with claim 22 wherein the carbon black particles are present in an amount of from about 2 to about 12 percent by weight, and the magnetite is present in an amount of from about 10 to about 30 percent by weight.

24. A toner composition in accordance with claim 22 wherein the carbon black is present in an amount of about 4 percent by weight, and the magnetite is present in an amount of about 15 percent by weight.

25. A method of imaging in accordance with claim 13 wherein fixing is accomplished with a fuser roll containing lead oxide and a vinylidine fluoride/hexafluoropropylene/tetrafluoroethylene terpolymer.

26. An improved positively charged toner composition consisting essentially of resin particles, pigment particles, and the charge enhancing additive distearyldimethyl ammonium methylsulfate.

27. A toner composition according to claim 26, wherein the charge enhancing additive is present in an amount from about 0.1 percent by weight to about 10 percent by weight.

28. A toner composition according to claim 26, wherein the resin particles are selected from the group consisting of polyesters, styrene polymers, and polycarbonates.

29. A toner composition according to claim 28, wherein the styrene polymers are styrene/butylmethacrylates, styrene/butylacrylates, or styrene butadiene.

30. A toner composition according to claim 26, wherein the pigment particles are carbon black.

* * * * *